US006105806A

United States Patent [19]

Stasiuk

[11] Patent Number: 6,105,806

[45] Date of Patent: Aug. 22, 2000

[54] LASER ETCHED PULL TAB CONTAINER OPENING DEVICES AND METHODS OF MAKING THE SAME

[76] Inventor: Joseph W. Stasiuk, P.O. Box 11318 APO, Georgetown, Grand Cayman, BWI, Cayman Islands

[21] Appl. No.: 09/061,227

[22] Filed: Apr. 17, 1998

Related U.S. Application Data

[63] Continuation-in-part of application No. 08/917,516, Aug. 26, 1997, abandoned.

[51] Int. Cl.[7] ..... B65D 17/34

[52] U.S. Cl. ..... 220/269; 220/906; 413/12; 413/25

[58] Field of Search ..... 220/269, 270, 220/906; 215/230; 206/459.5; 413/12, 14, 16, 25, 66; 40/306, 307, 628, 629, 637, 668; 426/87; D9/438, 451; 252/501.1, 520; 427/554, 555, 556; 216/65, 66, 94, 40; 219/69.1, 121.69, 121.85; 428/195

[56] References Cited

U.S. PATENT DOCUMENTS

| | | | |
|---|---|---|---|
| D. 210,870 | 4/1968 | Markert . | |
| D. 261,364 | 10/1981 | Smyth . | |
| D. 268,250 | 3/1983 | Smyth . | |
| D. 289,017 | 3/1987 | Spangler et al. . | |
| 3,281,024 | 10/1966 | Henchert et al. . | |
| 3,627,858 | 12/1971 | Parts et al. | 206/459.1 X |
| 3,796,344 | 3/1974 | De Phillips et al. . | |
| 3,822,496 | 7/1974 | Minder . | |
| 3,958,354 | 5/1976 | Hough et al. . | |
| 4,322,016 | 3/1982 | Barrash . | |
| 4,331,256 | 5/1982 | Helms . | |
| 4,363,179 | 12/1982 | Ruemer, Jr. et al. . | |
| 4,380,129 | 4/1983 | Barrash . | |
| 4,465,204 | 8/1984 | Kaminski et al. . | |
| 4,530,631 | 7/1985 | Kaminski et al. . | |
| 4,578,329 | 3/1986 | Holsappel | 206/459.1 X |
| 4,998,641 | 3/1991 | Willoughby . | |
| 5,191,695 | 3/1993 | Pavely et al. . | |
| 5,215,864 | 6/1993 | Laakmann | 427/556 X |
| 5,416,951 | 5/1995 | Kayaki et al. . | |
| 5,492,077 | 2/1996 | Rose . | |
| 5,523,125 | 6/1996 | Kennedy et al. | 427/555 |
| 5,578,120 | 11/1996 | Takahashi et al. | 252/501.1 |
| 5,799,815 | 9/1998 | Lang . | |
| 5,855,969 | 1/1999 | Robertson | 427/555 |

FOREIGN PATENT DOCUMENTS

| | | | |
|---|---|---|---|
| 81794/94 | 9/1995 | Australia . | |
| 0 289 022 | 11/1988 | European Pat. Off. . | |
| 0 482 776 | 4/1992 | European Pat. Off. . | |
| 2 649 628 | 1/1991 | France . | |
| 2 750 396 | 1/1998 | France . | |
| 4 103 746 | 8/1992 | Germany . | |
| 197 01 547 | 3/1998 | Germany . | |
| 63-20591 | 8/1988 | Japan | 219/121.68 |
| 5-178346 | 7/1993 | Japan . | |
| 8-53121 | 2/1996 | Japan . | |
| 1 124 958 | 8/1968 | United Kingdom . | |
| 2 185 613 | 7/1987 | United Kingdom . | |
| 2 320 008 | 6/1998 | United Kingdom . | |
| 97/47397 | 12/1997 | WIPO | 427/555 |

*Primary Examiner*—Nathan J. Newhouse
*Attorney, Agent, or Firm*—Fulbright & Jaworski, L.L.P.

[57] ABSTRACT

A container opening device, container lid, or can top with a decorated feature, or in the case of an opening device, a symbolically shaped pull tab for attachment to a container to perform the dual functions of opening the container and decorating the container for equity, identification or promotional purposes. The pull tab may open the container by acting as a lever which presses against a tear strip in the container top defined by a tear line to separate the tear strip from the container top and open the container. The pull tab may perform a decorative and promotional function by having a decoration or a symbolic shape that is to be recognized as a picture, trademark, icon, character, or other symbolic item or logo. The decoration can be made by applying color, printing, embossing, laser removal of a coating and labels to the pull tab, lid or container. The pull tab or decoration can take the shape and design of corporate logos, trademarks, icons, etc. In an alternative embodiment, the pull tab may have a weakened portion so that a piece of the pull tab may be removable from the container as a token or memento.

7 Claims, 7 Drawing Sheets

LASER ETCHED PULL TAB CONTAINER OPENING DEVICES AND METHODS OF MAKING THE SAME

This application is a Continuation-in-Part of applicant's U.S. application Ser. No. 08/917,516 filed Aug. 26, 1997, entitled "Symbolic Pull Tab Container Opening Device."

BACKGROUND OF THE INVENTION

1. Field of the Invention

The invention relates to decorated substrates and, more particularly, to container opening devices, decorated containers, and methods of making the same.

2. Description of the Related Technology

U.S. Pat. Nos. 4,465,204 and 4,530,631 disclose traditional pull tab container opening devices commonly used on container tops and a method for manufacturing the tabs. U.S. Pat. No. Des. 289,017 discloses the design of a traditional pull tab.

U.S. Pat. No. 3,958,354 discloses the placement of a promotional piece in the finger hole of a traditional pull tab. U.S. Pat. No. 5,191,695 discloses a method for placing such a promotional piece in the finger hole of a pull tab.

U.S. Pat. No. 4,322,016 discloses placement of a pressure sensitive label on the underside of a pull tab for promotional purposes.

U.S. Pat. No. 4,363,179 discloses placement of a promotional material on the top of a can underneath of a pull tab.

U.S. Pat. No. 5,416,951 discloses a pull tab for attaching a decorative item to a sliding fastener such as a zipper.

SUMMARY OF THE INVENTION

The food and beverage industry has not utilized pull tab container opening devices for package enhancement, brand identification, brand marketing promotion, or informational purposes. Most existing pull tab only serve the function of allowing the user to open the can. See, e.g., U.S. Pat. Nos. 4,465,204, 4,530,631, and Des. 289,017. Pull tab openers have been used for package promotion by placing promotional pieces in the finger hole of the pull tab (See U.S. Pat. Nos. 3,958,354 and 5,191,695), placing pressure sensitive labels on the pull tab (See U.S. Pat. No. 4,322,016), and placing promotional material on the container top beneath the pull tab (See U.S. Pat. No. 4,363,179). However, all of these promotional concepts retain the traditional shape of a pull tab as shown in U.S. Pat. No. 4,465,204 in order to minimize the tab weight. None of the prior art contemplates using the top of the pull tab itself as a promotional or decorative piece or to provide information to the consumer. None of the prior art contemplates using the bottom of the pull tab itself as a decorative piece or to provide information to the consumer.

Accordingly, in one aspect of the invention there is provided a pull tab container opening device having informational, promotional or decorative materials integral therewith. In another aspect of the invention, there is provided a pull tab container opening device having a symbolic shape for promotional or decorative purposes. In a related aspect, there is provided methods of manufacturing pull tabs according to the invention.

In accordance with the present invention, there is provided a pull tab container opening device having a novel shape for use on a container end. Prior art pull tabs consist of an open-tab design wherein a nose portion and a ring-shaped grab portion for receiving a finger are attached to a container at an attachment point on the tab. The tab is made of a piece of sheet metal that has apertures punched out to form two rings and has the edges curled under the tab. The prior art design is intended to minimize the weight of the tab and maximize its strength.

In one embodiment, the pull tabs of the present invention include a grab portion attached to a nose portion with an attachment point between the nose portion and the grab portion. According to the present invention, minimizing the weight of the tab does not have overriding significance. Thus, the tab may be a continuous solid plate. Further, the tab does not require the edges to be curled under the tab for strength. The tab also does not require the edges to be curled under the tab to avoid sharp metal edges since the tab may be manufactured from other materials. In other words, the tab of the present invention could have either curled or uncurled edges. Therefore, the tab may be a substantially planar member or a flat sheet. In one embodiment, the planar faces of the tab are substantially parallel to one another throughout the tab.

The tabs of the present invention may be made of any material capable of functioning as a pull tab for a container, including aluminum, steel, plastic, or any natural, synthetic, composite, or other suitable material. The selection of suitable materials are well within the ability of one of ordinary skill in the art. The tabs may also include at least one finger aperture. Construction of suitable pull tabs according to the invention are well within the ability of one of ordinary skill in the art.

According to the invention, the tabs of the present invention may be riveted or otherwise attached to the top of a container at the attachment point on the tab. The tab acts as a lever with the fulcrum at the attachment point so that lifting the grab portion causes the nose portion to push down on the container top and open a tear strip portion on the top. The nose portion may be designed as known in the art to effectively open the tear strip.

According to one aspect of the invention, there is provided a decorative tab. The term "decorative tab" is intended to mean a pull tab having informational, promotional or decorative materials integral therewith. Informational, promotional or decorative materials are intended to include, but are not limited to, any word, number, name, symbol, color, design, or image; and such materials will be referred to as "tab decorations" hereinafter. A decorative tab according to the present invention may have at least one finger aperture associated therewith; however, in a preferred embodiment there is provided a decorative tab having a closed-tab design. The closed tab design provides additional space to accommodate tab decorations.

Accordingly, one object of the invention is to provide a decorative tab having a closed-tab design and having tab decorations thereon. In one embodiment, there is provided a decorative tab having tab decorations embossed, debossed, etched or inscribed thereon. In another embodiment there is provided a decorative tab having tab decorations applied or affixed thereto. Application or affixation of tab decorations may be carried out by any technological process including, but not limited to, inks, paints, silk screens, adhesives or glues. In another embodiment there is provided a decorative tab having an anodized surface, organic coating, or other coating applied thereto. The decorative tab may then be used as is, or, alternatively, the tab may then have tab decorations embossed, debossed, inscribed, etched, affixed or applied thereto. In still yet another embodiment there is provided a decorative tab having a plurality of layers which can be mechanically or chemically manipulated such that tab decorations of different colors or shades are provided on the tab.

Various coatings may be used. Suitable coatings include those conventionally used in the beverage container field. Alcoa supplies stock with suitable coatings supplied by Dexter, Valspar, BASF and others. The coating type is not limited to epoxy, vinyl or an anodized coating. If may be preferable to use a coating that contrasts with the color of the underlying material, which may be aluminum, other materials, or another coating layer. In addition, multiple layers of contrasting coatings may be used so that selective removal of layers may reveal a multiple color design.

It is a related object of the invention to provide a decorative tab having a coating and having tab decorations generated thereon by a laser or other optical device. In one embodiment there is provided a decorative tab having an uncoated surface, anodized surface or coated surface, or multiple layers of such surfaces, which is then treated with at least one optical device that generates substantially permanent tab decorations thereon. In another embodiment there is provided a decorative tab having an organically coated surface that is treated with at least one optical device that generates substantially permanent tab decorations thereon. In yet another embodiment there is provided a decorative tab having a plurality of layers which may be treated with at least one optical device that generates substantially permanent tab decorations of more than one color or shade thereon.

It is a related aspect of the invention to provide a decorative tab comprised of a material or materials capable of having tab decorations generated thereon (or therein) when treated with at least one optical device.

According to another aspect of the invention, there is provided a symbolic tab. The term "symbolic tab" is intended to mean a pull tab container opening device having a symbolic shape which allows it to simultaneously function as a container opener and a promotional or decorative piece. A symbolic shape means that the pull tab is shaped to be recognized as a picture, trademark, icon, character, or other symbolic item. Examples include a pull tab having the symbolic shape of a corporate logo, a trademark, a character, a Christmas tree, a football helmet, piece of fruit, etc. Thus, the tab could be utilized to promote products, facilitate redemption contests, and provide mementos for the purchaser. To effect the symbolic shape, the pull tab has a different shape than prior art pull tabs.

To enhance the symbolic shape, any of the methods discussed in connection with decorative tabs may be used to decorate the symbolic tab. Thus, in one aspect of the invention there is provided a decorative-symbolic tab. For example, an image may be attached to the symbolic tab. The image may be attached to the by tab any technological process including printing, embossing, debossing, silk screening, laser etching, or any other appropriate means. Any type of image may be attached to the symbolic tab including photographs, trademarks, holographs, bar codes, or any other appropriate image. The tab can simply be made from pigmented, colored stock in order to yield a specific image. Alternatively, the tab can be made from bare tab stock and subsequently decorated by printing, dyeing, or other appropriate means. In addition, an adhesive label may be attached to the tab.

The decorative and symbolic tabs according to the present invention may also be made in a severable two piece design. In such a design the tab has a weakness or perforation built into the tab between the grab portion and nose portion. After the tab pushes open the tear strip, the grab portion is removable from the tab as a token or memento. The weakness or perforation may be biased to permit exertion of a relatively higher force on the tab in the opening direction without separating the two portions and to permit exertion of a relatively lower force on the tab in the opposite direction which will separate the two portions.

According to another aspect of the invention, there is provided a die area of a conversion press modified such that the stamping and forming steps of manufacturing a pull tab yield a pull tab in accordance with the present invention as described above. The tab may be formed from narrower or wider tab stock than that used in traditional manufacturing methods. Subsequent forming of the grab portion can emboss or otherwise shape the grab portion, and also cut a finger aperture therein. The nose portion may be formed in the traditional manner as known in the art. Riveting or attachment of tabs to container lids may be done according to any of the methods generally known in the art.

The present invention also relates to methods of making decorative tabs as described above. Tabs can be formed by a conversion press and stamped and formed by the modified tab die area of the present invention. Tab decorations can be applied on the monolithic tab stock, on formed tab stock strip, or on the tabs after exit from the conversion press. Mechanical or computer recognition systems may be utilized to assure accurate and uniform application of the tab decorations. In a preferred embodiment of the present invention, there is provided at least one laser to etch tab decorations on tabs. The laser may be positioned at any point or place to etch the tab stock prior to initial entry into the conversion press, to etch the formed tab stock strip after exit from the forming and curling dies of the conversion press, or to etch the tabs after conversion and exit from the conversion press.

DETAILED DESCRIPTION OF THE PREFERRED EMBODIMENT

Figure 1:
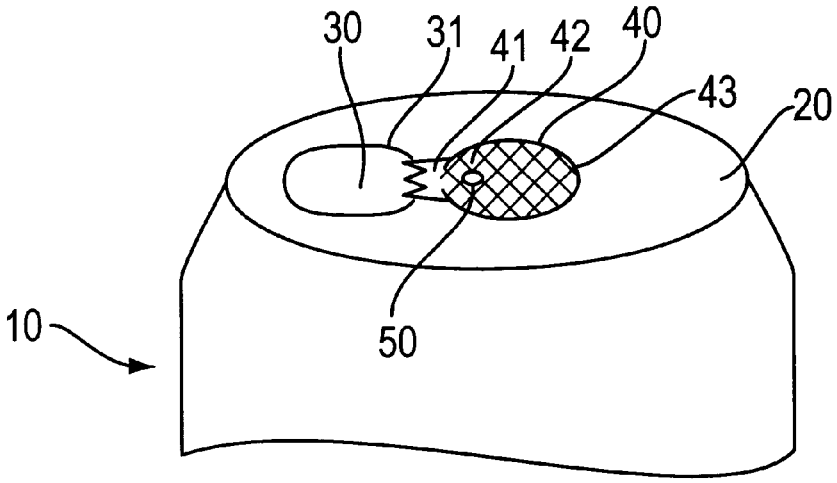
FIG. 1 is a perspective view of a container incorporating a pull tab container opening device according to the present invention.
Figure 2:
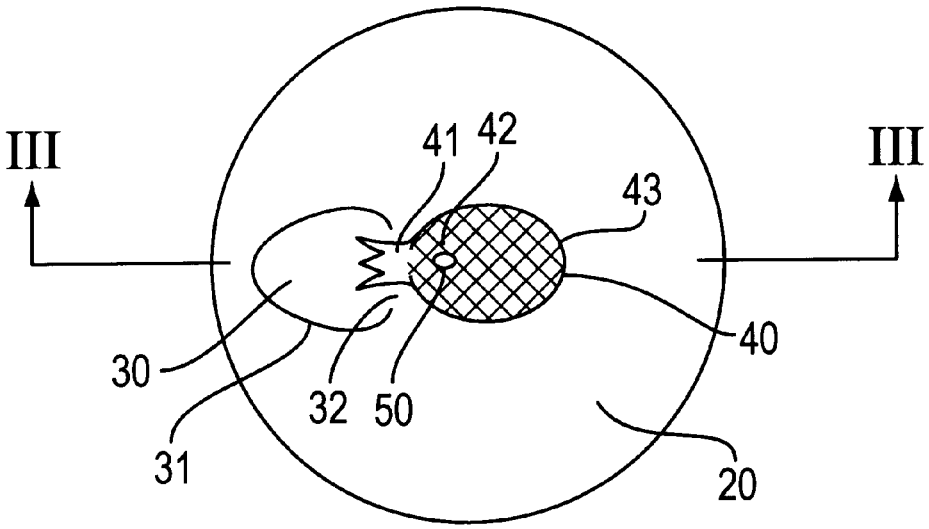
FIG. 2 is a top plan view of the container in FIG. 1.

A representative pull tab container opening device according to the present invention is indicated generally at 40. In the first preferred embodiment, as shown in FIGS. 1–2 and 3A–D, the pull tab 40 is attached to a container 10. The pull tab 40 includes a nose portion 41 and a grab portion 43. The container includes a top 20. The top includes a tear strip 30 defined by tear line 31 and a tear line interruption 32.

Figure 3A:
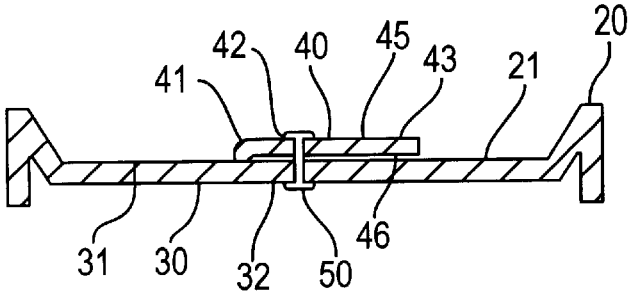
FIGS. 3A–3D are cross-sectional views taken along line III—III of FIG. 2. These figures show the steps in using the pull tab to open the container.
Figure 3B:
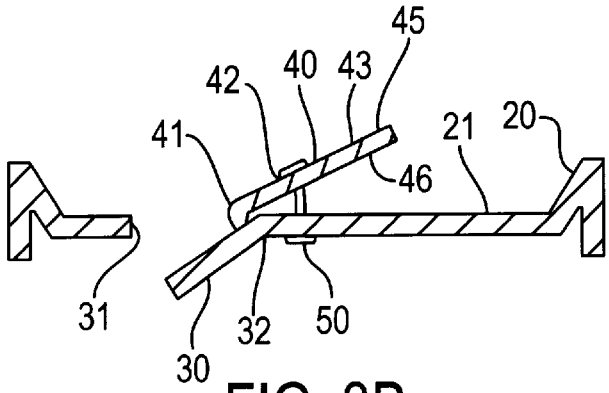
Figure 3C:
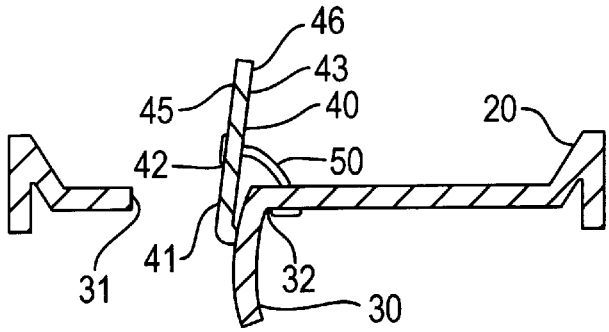
Figure 3D:
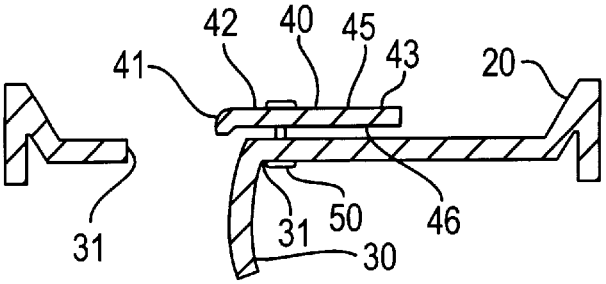

The pull tab 40 has an attachment point 42 attached to the container top 20 by a rivet 50 so that the nose portion 41 of the pull tab 40 is articulating against tear strip 30. As shown in FIGS. 3A–3D, the pull tab 40 acts as a lever with the fulcrum at the attachment point 42 to open tear strip 30. When the user lifts grab portion 43, nose portion 41 applies a downward force to tear strip 30 causing the tear strip 30 to separate from container top 20 along tear line 31. Tear line interruption 32 holds tear strip 30 to container 20 and prevents it from dropping into the container. After actuating the pull tab 40 to open container top 20, pull tab 40 can then be bent back to its original position as shown in FIG. 3D.

In the embodiment depicted in FIGS. 1–2 and 3A–D pull tab 40 has a symbolic shape to decorate the container. The drawings show the symbolic tab having the symbolic shape of a pineapple. To enhance the symbolic shape, tab decorations such as the texture of the pineapple may be embossed on the tab and/or the colors of the pineapple may be printed upon the tab. However, one could envision alternative pull tab symbolic shapes including, but not limited to, corporate logos, trademarks, characters, icons, etc. One could also envision alternative tab decorations being provided on the tab.

To facilitate the tab having a symbolic shape, the tab may be a continuously solid plate. There is no need to have apertures in the tab. In the depicted embodiment, the solid plate is a substantially planar member having a top planar face 45 and a bottom planar face 46 that are substantially parallel to one another. In other words, the tab is made from a substantially flat sheet of material having substantially uniform thickness throughout. However, the symbolic shape could also be achieved in an embodiment wherein the pull tab is not a continuously solid plate, has apertures, is not a planar member and is not a substantially flat sheet. The tab is preferably shaped to be recognized as a picture, trademark, icon, character, or other symbolic item.

Figure 4:
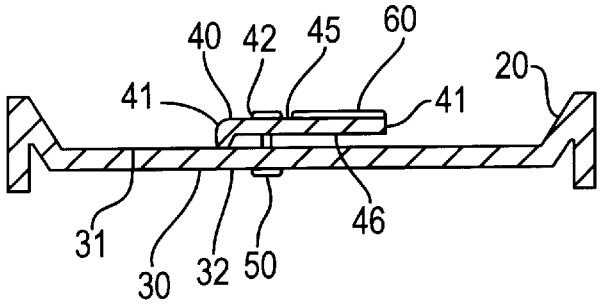
FIG. 4 is a cross-sectional view similar to FIG. 3A and showing an embodiment comprising an adhesive label attached to the pull tab.

FIG. 4 shows a second preferred embodiment of the invention. In this embodiment, a tab decoration comprising an adhesive label 60 is attached to the pull tab 40 to further enhance the pull tab's symbolic shape for promotional purposes. The label may be attached to any portion of the pull tab. The pull tab 40 has the same symbolic shape as discussed above in reference to FIGS. 1–2 and 3A–3D.

Figure 5:
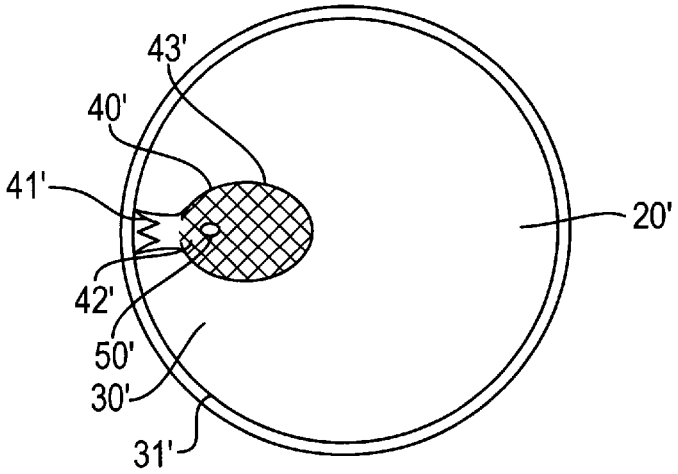
FIG. 5 is a top plan view of an alternative embodiment of the invention wherein the a pull tab is attached to a container in which almost the entire top of the container is removable along with the pull tab.

FIG. 5 shows a third preferred embodiment of the invention. In this embodiment the pull tab 40' has the same elements and symbolic shape as pull tab 40 described above and is attached to the container top 20' by rivet 50'. However, in this embodiment, the tear strip 30' encompasses almost the entire container top 20'. Tear line 31' extends along the entire circumference of the container top 20' without any interruption. In this design, the user lifts the pull tab grab portion 43' which causes the pull tab portion 41' to begin to tear the tear strip 30' along tear line 31'. The user then pulls the pull tab 40' towards the opposite side of the container to completely remove the pull tab 40' and the tear strip 30' from the container. In this embodiment, the pull tab 40' has the same symbolic shape as the pull tab 40 discussed above in reference to FIGS. 1–4.

Figure 6:
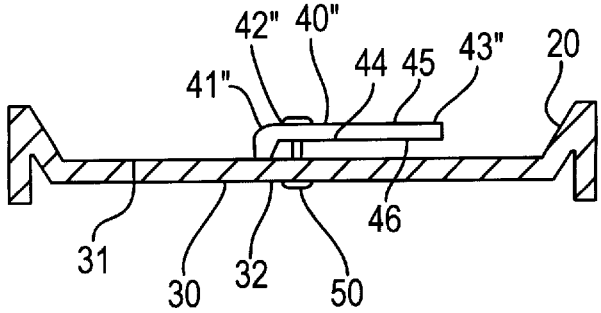
FIG. 6 is a cross-sectional view similar to FIG. 3A and showing an alternative embodiment wherein the pull tab is formed in two pieces so that the pieces are severable from each other.

FIG. 6 shows a fourth preferred embodiment of the invention. In this embodiment, the pull tab 40" is formed as two pieces such that the grab portion 43" is severable from the nose portion 41". The pull tab 40" is made with a weakened portion 44 such as a scored line or perforation. The weakened portion extends at an angle between the grab portion 43" and the nose portion 41" so that the user may lift the grab portion 43" to actuate the nose portion 41" against the tear strip 30" without separating the grab portion 43" from the nose portion 41". After opening the tear strip 30", the grab portion 41" may be removed from the nose portion 43" by applying pressure in the direction of the weakened portion 44. The pull tab 40" has the same symbolic shape as pull tab 40 as discussed above in reference to FIGS. 1–4. The two piece design further enhances the promotional or decorative function of the pull tab by allowing the user to keep a portion of the tab as a memento or token.

Figure 7:
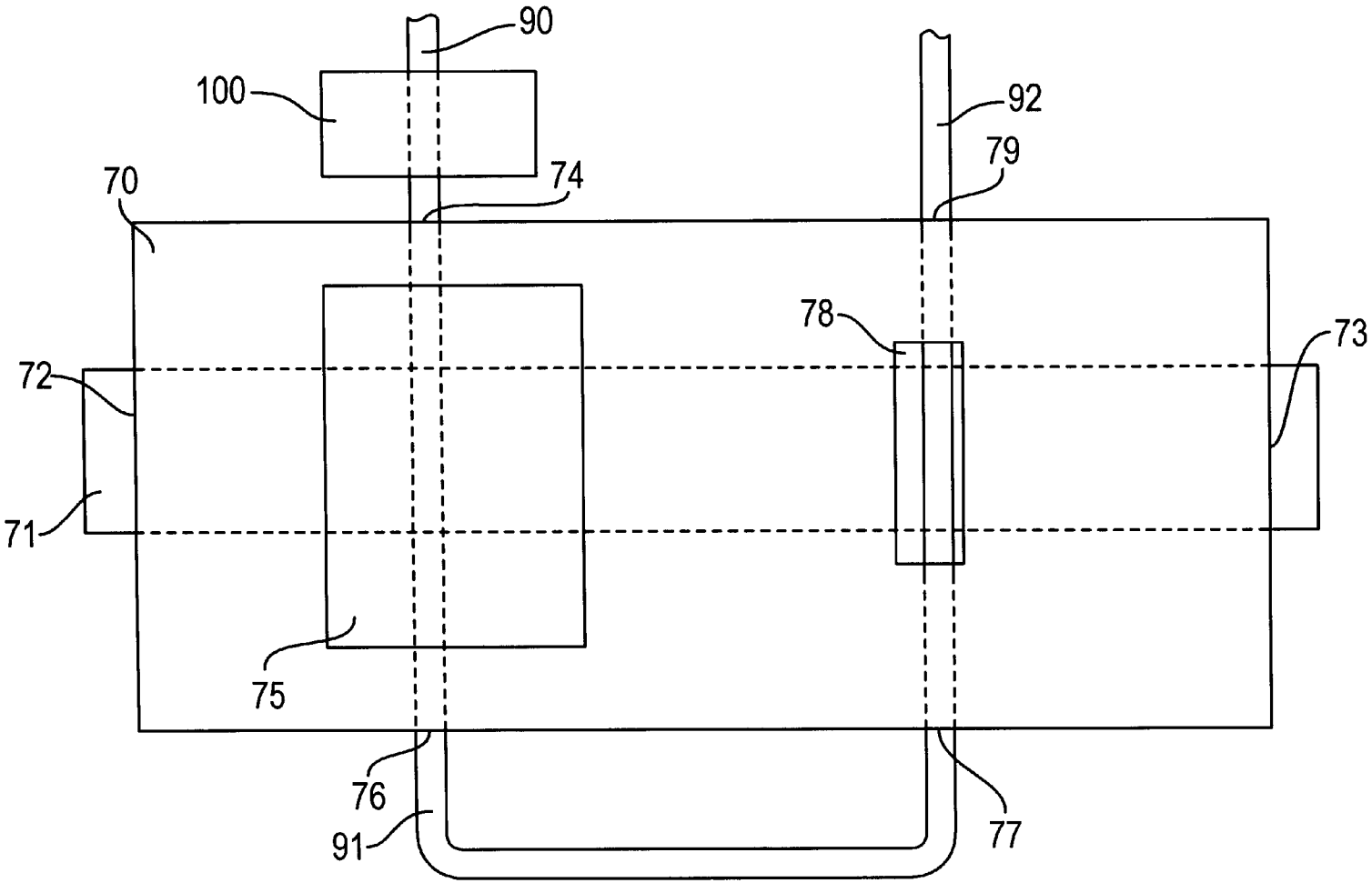
FIG. 7 is a top view of an embodiment of a pull tab manufacturing apparatus according to the present invention.
Figure 8:
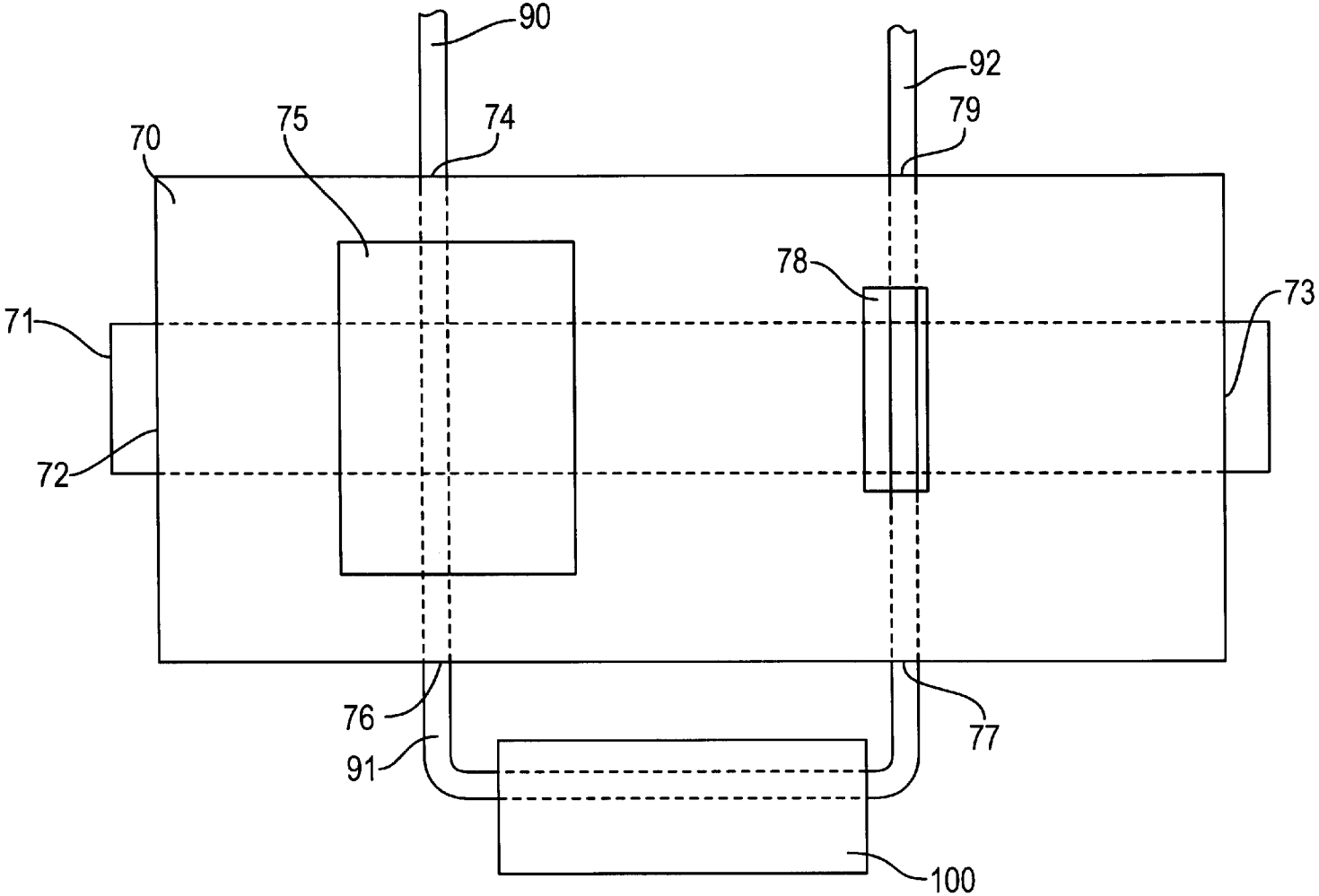
FIG. 8 is a top view of an alternative embodiment of a pull tab manufacturing apparatus according to the present invention.
Figure 9:
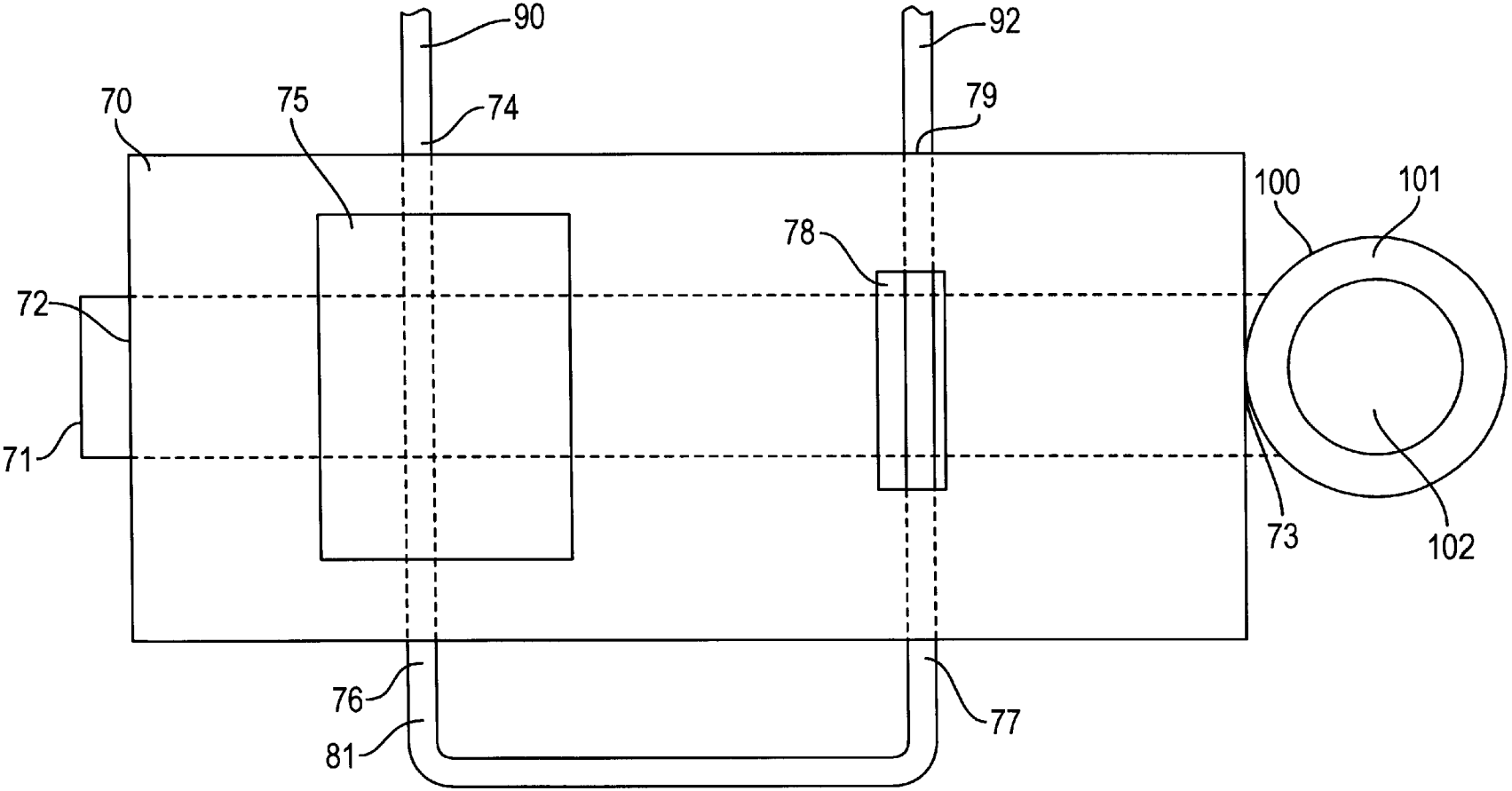
FIG. 9 is a top view of another alternative embodiment of a pull tab manufacturing apparatus according to the present invention.

A representative apparatus for manufacturing pull tabs according to the invention is depicted in FIGS. 7–9. In a first embodiment, as shown in FIG. 7, the apparatus comprises a modified conversion press 70. Typical conversion presses for the manufacture of prior art tabs are commercially available from such companies as Burderer or Minister. The modified press 70 includes a container end conveyer 71 for transporting container ends through the press 70. The container end conveyer 61 has an inlet 72 for accepting untabbed container ends and an outlet 73 through which tabbed container ends may be collected. The conveyer 71 transports container ends from the inlet 72, through the press 70, to the outlet 73, where tabbed container ends may be collected.

As depicted in FIG. 7, the press 70 also includes a tab stock inlet 74 and a formed tab strip outlet 76. Interposed between the tab stock inlet 74 and tab strip outlet 76, and transversing the conveyer 71, is a die area 75. As generally known in the art, the die area 75 comprises a plurality of cutting and stamping dies (not shown) which operate to form and shape materials pressing therethrough into a desired configuration. The die area 75 may treat container ends as they pass through the die area 75 on conveyer 71. According to the invention, tab stock 90 may enter the press 70 through the tab stock inlet 74. As depicted in FIG. 7, a strip of tab stock 90 enters through the inlet 74 and then passes into the die area 75 where it is cut and shaped into formed tabs. The formed tab strip 91 may then exit the press 70 through formed tab strip outlet 76.

In a preferred embodiment, the die area 75 is composed of a plurality of interchangeable cutting dies and stamping dies. As will be appreciated by one of ordinary skill in the art, interchangeable parts allows a single press to be used in manufacturing a plurality of differently shaped symbolic and decorative tabs of a plurality of different materials. For example, the die could be rigged to produce a tab lacking a finger aperture by removing or blocking the aperture cutting dies. Further, the die area could be arranged to cut the pineapple shaped tab depicted in FIGS. 1–2 and 3A–D. Also, the die area could be arranged such that the tabs are stamped to emboss a pineapple-like texture onto the tab. In addition, the die area could be arranged such that the pineapple grab portion is scored such that it is detachable from the nose portion. Accordingly, numerous other modifications to the die area to produce symbolic and decorative tabs can be fully appreciated by the skilled artisan in view of this specification.

The formed tab strip 91 after exiting the press 70 through formed tab strip outlet 76 may reenter the press 70 through the formed tab strip inlet 77. The formed tab strip 91 is then fed into a riveting area 78 adjacent the conveyer 71. In the riveting area 78 formed tabs are removed from the formed tab strip 91 and riveted to container ends entering the rivetting area 78 via the conveyer 71. The formed tab strip scrap 92 then exits the rivetting area 78 and, ultimately, the press 70 through the tab scrap outlet 79. Container ends exit the riveting area 78, having tabs riveted thereto, by means of the conveyer 71. The conveyer ultimately feeds the tabbed container ends out of the press 70 at the conveyer outlet 73 where the container ends may be collected. The tab strip scrap 92 exiting the tab scrap outlet 79 may also be collected and used for other purposes, such as being recycled into fresh tab stock 90.

Tab stock 90, according to the invention, may comprise any material capable of use as a pull tab container opening device. Exemplary materials include aluminum, steel, plastic, or any natural, synthetic, composite, or other suitable material. Similarly, combinations of materials as layers or otherwise may also be used. Accordingly, one of ordinary skill in the art will understand that corresponding manipulation of the modified press 70 may be necessary to accommodate different materials. In a preferred embodiment, the tab stock 90 comprises aluminum. As depicted in FIG. 7, aluminum tab stock strips may be any suitable width and of any desired length. Generally, existing presses accommodate tab stock of either 1.9 or 2.8 inches in width and 0.009–0.010 inches in depth. According to the present invention, the depth of the stock can be increased, depending on the strength desired and the material used. A preferred embodiment contemplates an aluminum strip of about 1–3 inches in width and about 0.0125 inches in depth.

Colored tab stock 90 may be used with the present invention if colored decorative are desired. To effectuate the coloring, pigmentation may be used while forming the tab stock 90, or alternatively, the tab stock 90 may be coated with a colored material. Similarly, as will be appreciated by one of ordinary skill in the art, other colored or coated materials, such as plastics, may be used.

To further enhance the decorative or symbolic power of the tabs, a tab decorating area 100 may be used. The tab decorating area 100 may be an area within the modified press 70, such as for example, embossing stamps or a silk screening station. Alternatively, the tab decorating area 100 may be located outside the press 70, although it may still be in-line or integral with the press 70. Embossing or other decorating may also be performed within the die area 75.

In a preferred embodiment as depicted in FIG. 7, the tab decorating area 100 is located at an area whereby the tab stock 90 can be decorated prior to entering the tab stock inlet 74. The tab decorating area 100 may be integral with the feed mechanism that feeds tab stock 90 into the tab stock inlet 74; or alternatively, the tab decorating area 100 may be situated at a location for treating tab stock 90 which is not even housed in the area where the press 70 is located. In other words, the tab stock 90 may be decorated and then brought to a location housing a press 70.

FIG. 8 depicts an alternative embodiment of an apparatus for manufacturing pull tabs in accordance with the present invention. With reference to FIG. 7, like reference numerals refer to the same elements; however, in this embodiment the tab decorating area 100 is located outside the press 70 but in-line with the tab stock 90 such that the formed tab strip 91 exits the press 70 at tab strip outlet 76 and then passes through tab decorating area 100 prior to reentering the press 70.

Although it is contemplated that the tab decorating area 100 may perform all of the decorating functions within the scope of the invention no matter where it is housed, placement of the tab decorating area 100 in-line and capable of receiving the formed tab strip 91 is a preferred process. First, the tabs are already formed in the strip which may enhance the speed and ability of the apparatus, through mechanical orientation or computer recognition, or otherwise, to provide substantially the same tab decorations on each tab. Secondly, the tab decorating area 100 may be used in connection with an actuator (not shown) that may be used to allow the die area 75 to operate at a faster pace than can be accommodated by the tab decorating area 100.

FIG. 9 depicts another alternative embodiment of an apparatus for manufacturing tabs in accordance with the present invention. With reference to FIGS. 7 and 8, like reference numerals refer to like elements; however, the tab decorating area 100 in FIG. 9 is located at an area for receiving tabbed container ends exiting the conveyer 71 at the conveyor outlet 73. In the specific embodiment depicted in FIG. 9, the tab decorating area 100 is of a generally cylindrical shape. Disposed within the tab decorating area 100 is a cylindrical track 101 for accepting a plurality of tabbed container ends. The tab decorating area 100 also has an interior section 102 encircled by the cylindrical track 101.

In this embodiment, tabbed container ends exit the conveyor 71 at the conveyor outlet 73 and are received by the cylindrical track 101 of the tab decorating area 100. The track 101 may be rotated in either direction such that the container ends may be rotated to or through one or more stations. With this arrangement, different tab decorations can be supplied to the tabs, or container ends, at different stations. Tab decorating machinery may be disposed within the interior section 102 of the tab decorating area 100 and/or located on the outer perimeter of the track 101. This embodiment may be preferred, or in combination with the previous embodiments, if decorations are to be supplied not only to the tabs, but also to the container ends.

The tab decorating area 100 of the present invention may be configured in any manner suitable for placing tab decorations on the tab stock, formed tab strip, or tabs before or after attachment to the container. The exact layout and design of the tab decorating area will vary according to the decorating methods to be used and the materials to be decorated. The tab decorating area may comprise an apparatus for embossing, debossing, inscribing or etching tab decorations, or any combination thereof. Similarly, the tab decorating area may comprise alone, or in combination with the above, any apparatus suitable for printing, screening, painting, adhering, gluing or otherwise placing or generating tab decorations on tabs or tab-making materials. The tab decorating area may make use of mechanical orientation or computer controlled artificial recognition systems to help ensure that the tab decorations appear substantially the same on the end product. It is also within the scope of the invention to make use of a plurality of tab decorating areas, for example, a combination of FIGS. 7–9.

A preferred apparatus for use in a tab decorating area is an optical device, preferably a laser, capable of generating a substantially permanent tab decoration on a tab or tab making materials. For example, in making decorative or decorative-symbolic tabs for an aluminum container, anodized aluminum or aluminum coated with an organic coating may be used. Preferably, aluminum having an organic coating on at least one side is used. A plurality of coatings may also be used if a tab having multiple colors is desired. The anodized or coated aluminum is then treated with a laser that burns or etches a predetermined tab decoration into the tab or tab material such that aluminum shows through the coating or anodized layer. The laser may also be set such that a texture is provided. If multiple coatings are used, the laser may be set such that a portion of the top layer of coating is etched to a desired depth (preferably a depth exposing the second layer or bare aluminum) and the second layer is also etched to a desire depth exposing a successive layer or bare aluminum, etc . . . . Accordingly, one of ordinary skill in the art will appreciate that numerous modifications to the coatings and laser settings may be done to effect speed of production, clarity of the tab decorations, depth of the etch, and desired pattern colors. Presently preferred lasers are high powered lasers or lasers with precision marking capability, such as a 200 watt NDYAG (Neoderium Yttrium Aluminum Garnet) laser or a $CO_2$ laser. The CO2 laser may be 600 watts.

In view of the foregoing, one of ordinary skill may appreciate how the decorative-symbolic tab depicted in FIGS. 1–2 and 3A–D may be manufactured for an aluminum container. For example, aluminum tab stock 90 may be provided having a first coating green in color and a top coating brown in color. The coatings may be applied at a first tab decorating area 100 located adjacent the tab stock inlet 74, or alternatively, an area away from the modified press 70. The tab stock 90 may be fed into the modified conversion press wherein the tab stock 90 is introduced into a die area 75 where a series of cutting and stamping dies transform the tab stock 90 into a formed tab strip 91 having tabs in the shape of a pineapple thereon, and possibly having an embossed pineapple-like texture. The formed tab strip 91 may then exit the conversion press 70 and enter a second tab decorating area 100 wherein mechanical orientation or computer controlled artificial recognition devices are used to ensure the formed tabs are correctly positioned in order to receive substantially similar tab decorations. A laser, or series of lasers, then burn or cut through a portion of the top coating exposing the green layer in an area near the nose portion corresponding to the pineapple's leaves. The laser, or lasers, also, simultaneously or in succession, burn or cut-through a portion of both coatings to expose the aluminum present underneath such that a pineapple pattern is generated. The laser, or lasers, or alternatively the thickness of the coatings may be adjusted prior to performing the process such that a pineapple-like texture will be provided by the process. The formed tab strip 91 then reenters the modified press 70 wherein the tabs are riveted to container ends in the riveting area 75. The tabbed container ends then exit the press for further treatment in yet another tab decorating area 100 or they may be collected and attached to container bodies.

According to a further feature, the tab stock may be pre-etched or pre-marked, by laser or other means off line, prior to the formation process. The tabs may be etched or otherwise marked off line, after they are staked to the can tops. The invention also contemplates laser etching coated or anodized can tops, other portions of cans, aluminum or metallic bottle caps, plastic bottle caps, or other parts of beverage containers.

Figure 10:
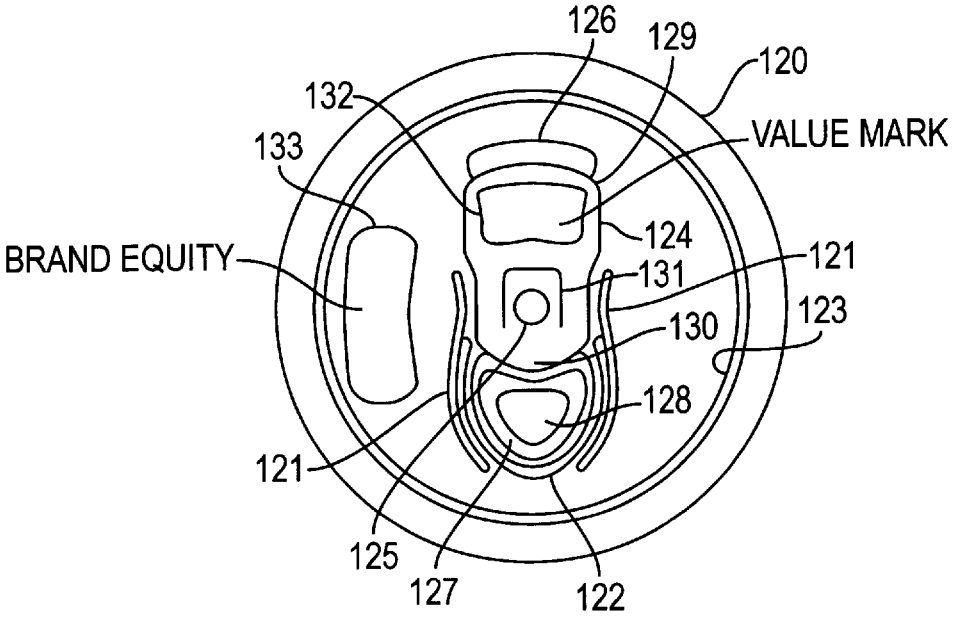
FIG. 10 shows a top view of a can top according to one embodiment of the invention.

FIG. 10 shows a can top 120. Formation of the can top 120 and pull tab can be done in a conversion press. During the can top formation process various bubbles and deformations known as "coins" may be imparted into the can top in order to enhance the strength thereof. The can top of FIG. 10 shows anti-buckle coins 121. The can top also includes a top opening score 122 and a top rim 123. A tab 124 is rivetted, or staked, onto a button 125 in the can top by a re-strike action of the conversion press. An additional coin 126 is also shown. Other deformations 127 may also be present to enhance the strength of the scored panel 128 to provide access to the contents of the container. The pull tab has a grab portion 129 which may be lifted to apply pressure through the nose portion 130 to the scored panel. A slit 131 is advantageously provided in the tab in order to facilitate its action as a lever with the staked button 125 acting as a fulcrum at the connection point. The grab portion is advantageously a closed-tab and exhibits a decoration 132 illustrated as a "VALUE MARK" logo.

According to an advantageous embodiment, the tab is fabricated from tab stock that is thicker than 0.01 inches, and preferably 0.0125 inches. The tab stock is coated with an organic coating material and the decoration is applied by a laser etching process. The can top itself may also be coated with an organic coating and a decoration 133 may be applied to the can top. The decoration 133 is shown as the "BRAND EQUITY" logo. The method for application of the decoration is preferably through the use of a laser to remove a portion of one or more coating layers to reveal a design.

Figure 11:
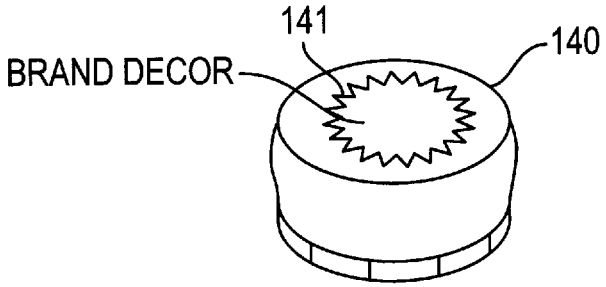
FIG. 11 shows a bottle cap with a laser etch decoration according to one embodiment of the invention.

FIG. 11 shows an alternative embodiment of the invention. A container lid, such as a bottle cap 140, may also have a decoration 141 thereto. Once again, the decoration is advantageously applied by use of a laser to remove one or more layers of a coating material. The decoration in FIG. 7 is illustrated as the "BRAND DECOR" logo.

Figure 12:
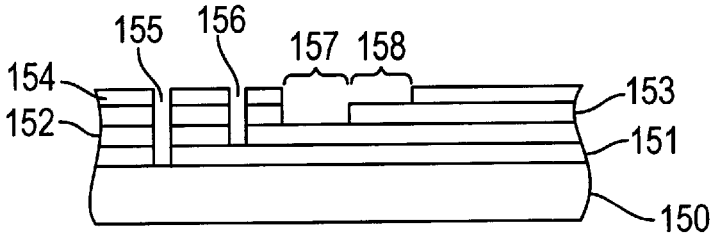
FIG. 12 shows a multi-layer structure according to one embodiment of the invention.

FIG. 12 shows an illustration of an application technique for a design according to the invention. A substrate 150 is provided. According to an advantageous embodiment, the substrate may be the aluminum tab, or some other material to be decorated or marked. According to an advantageous embodiment, this material is a portion of a food or beverage container such as a top, a lid, or a container body or bottom. However, any other material may also be marked. As stated above, the substrate may be made of any suitable material and may form a part of a can top, a bottle cap, container lid, or any other portion of a container device.

A substrate may be coated with one or more contrasting layers. FIG. 12 shows four layers of coatings, which may be any suitable colors or advantageously, a cyan layer 151, a magenta layer 152, a yellow layer 153, and a black layer 154. When the substrate is aluminum, a removal of all four layers, such as an area 155 reveals a natural aluminum color. Area 156 shows the removal of three layers revealing a cyan color. Area 157 shows the removal of two layers revealing a magenta color. Area 158 shows removal of a single layer revealing a yellow color. In the illustrated example, all areas with no layers removed will remain black. In this fashion, virtually any color can be generated.

It is understood that many modifications to this invention may be made without departing from the spirit of the invention. The appended claims express the scope of the invention.

What is claimed is:

1. A container opening device comprising:

a pull tab exhibiting a substantially planar member having an attachment point for attachment to a container with a closed grab portion oriented to one side of said attachment point and a nose portion oriented on an opposite side of said attachment point;

said pull tab actuatable to open the container;

an epoxy coating layer disposed on said pull tab; and a laser etched image defined on said pull tab; wherein said image is created by a localized laser removal of said coating layer to expose an uncoated surface of the pull tab.

2. A container opening device according to claim 1, wherein said pull tab is made of a composite material.

3. A container opening device according to claim 1, wherein said pull tab is made of a natural material.

4. A container opening device according to claim 1, wherein said pull tab is made of a synthetic material.

5. A container opening device comprising:

a pull tab-exhibiting a substantially planar member having an attachment point for attachment to a container with a closed portion oriented to one side of said attachment point and a nose portion oriented on an opposite side of said attachment point, said pull tab actuable to open the container;

an epoxy coating layer disposed on said pull tab;

a laser etched image defined on said pull tab; wherein said image is created by a localized laser removal of said coating layer to expose an uncoated surface of the pull tap, and wherein said pull tab is made of metal.

6. A container opening device according to claim 5, wherein said metal is aluminum.

7. A container opening device according to claim 6, wherein said aluminum is an alloy.

* * * * *